US006837336B2

(12) United States Patent
Gault et al.

(10) Patent No.: US 6,837,336 B2
(45) Date of Patent: Jan. 4, 2005

(54) APPARATUS FOR TREATING A GAS STREAM

(76) Inventors: Anthony John Gault, 383 Ropery Road, Gainsborough, Lincolnshire (GB), DN21 2TR; David Herbert Milles, Red House Walesby, Market Rasen, Lincolnshire (GB), LN8 3UR ( * ) Notice: Subject to any disclaimer, the term of this patent is extended or adjusted under 35 U.S.C. 154(b) by 44 days.

(21) Appl. No.: 10/149,325

(22) PCT Filed: Dec. 8, 2000

(86) PCT No.: PCT/GB00/04690

§ 371 (c)(1),
(2), (4) Date: Oct. 15, 2002

(87) PCT Pub. No.: WO01/42630

PCT Pub. Date: Jun. 14, 2001

(65) Prior Publication Data

US 2003/0108457 A1 Jun. 12, 2003

(30) Foreign Application Priority Data

Dec. 9, 1999 (GB) ..... 9929091
Feb. 16, 2000 (GB) ..... 0003541

(51) Int. Cl.[7] ..... F01N 1/24
(52) U.S. Cl. ..... 181/258; 84/211
(58) Field of Search ..... 181/258, 255, 181/249, 250, 251, 243, 241, 238, 232, 231, 224, 212, 216, 219, 257

(56) References Cited

U.S. PATENT DOCUMENTS 3,998,599 A 12/1976 Fedor ..... 23/288 FC
4,846,302 A * 7/1989 Hetherington ..... 181/243
4,866,932 A 9/1989 Morita et al. ..... 60/288
5,043,147 A * 8/1991 Knight ..... 422/180
5,367,131 A * 11/1994 Bemel ..... 181/232
6,158,214 A * 12/2000 Kempka et al. ..... 60/302

FOREIGN PATENT DOCUMENTS

| | | | |
|---|---|---|---|
| EP | 0153157 | 8/1985 | 53/36 |
| GB | 1052106 | 12/1966 | |
| GB | 1435608 | 5/1976 | 3/15 |
| GB | 1502111 | 2/1978 | 3/15 |
| GB | 1592749 | 7/1981 | 3/10 |
| WO | WO9743528 | 11/1997 | 3/28 |

* cited by examiner

*Primary Examiner*—Kimberly Lockett
(74) *Attorney, Agent, or Firm*—Bourque & Assocs. PA

(57) ABSTRACT

The invention provides apparatus for treating a gas stream, notably a silencer assembly for use to treat the exhaust gasses from an internal combustion engine, which apparatus comprises a plurality of compartments within which one or more treatments are to be performed on a gas stream passing through the compartment, and through which the gas stream is to flow sequentially, characterised in that:

a. At least two of said compartments each comprises a tubular body member containing or carrying a treatment element which is restrained against axial movement relative to the body member; and
b. The tubular body members of the adjacent compartments are provided with radially outwardly and/or inwardly extending terminal flanges, at least some of which flanges provide a shoulder against which the opposing terminal portion of the adjacent compartment bears so as to form an axially extending structure comprising at least two compartments in axial or coaxial relationship to one another; and
c. One or more clamping members which extend axially over substantially the length of the said structure and act upon the axial structure to secure the two adjacent compartments together in gas-tight engagement by an axial clamping action.

11 Claims, 4 Drawing Sheets

APPARATUS FOR TREATING A GAS STREAM

TECHNICAL FIELD

The present invention relates to an apparatus, notably to a gas treatment chamber for treating the exhaust gases of an internal combustion engine for motor vehicles and other applications.

BACKGROUND TO THE INVENTION

Diesel engine exhaust gases contain a number of noxious gases, such a nitrogen oxides, sulphur oxides and carbon oxides, as well as un-burnt hydrocarbons, carbon and other particles. The amount of sulphur oxides in the exhaust gases is dependent primarily upon the sulphur in the fuel and is controlled by the quality of the initial crude oil and the refining techniques used in the preparation of the fuel. However, the other materials can be treated so as to render them less obnoxious.

It is therefore common practice to pass the exhaust gases through a silencer assembly which contains one or more treatment chambers containing a catalytic converter in which the lower nitrogen oxides are converted to $NO_2$. The carbon particles and droplets of un-burnt hydrocarbons, for convenience collectively denoted hereinafter as particulates, are removed from the exhaust gas stream by a metal gauze or mesh or a ceramic filter element. The $NO_2$ and oxygen in the gas stream react with the particulates trapped in the filter element to form carbon dioxide and water, which are then discharged with the other exhaust gases.

If desired, the filtered gases can be subjected to reduction of remaining nitrogen oxides to nitrogen by injecting urea into the gas stream after it leaves the filter element but before it leaves the silencer assembly. The treated gas stream is then passed over an oxidising catalyst to convert residual ammonia from the urea to nitrogen and water, which are acceptable exhaust emissions. The net result is a typical reduction in noxious components of the exhaust gases of over 90%.

Silencer assemblies containing such treatment chambers are typically built on a modular basis as a series of generally cylindrical or oval cross section module units, each containing an element, the treatment element, required to achieved one of the desired treatments on the exhaust gas stream. Typically, each module comprises the treatment element as a cylindrical body surrounded by a shock absorbent ceramic sleeve, located by internal circumferential annular ribs or flanges within a metal, usually stainless steel, tubular body member. Thus, one module may contain the catalyst carried on a foraminous ceramic or other support, for example a rolled corrugated metal sheet with an interleaf of a flat metal sheet between each layer of the corrugated sheet to form a plurality of triangular or other cross section axial passages in a cylindrical or annular support, or as a noble metal wire mesh through which the exhaust gases pass. A second module may contain the cast porous or fritted ceramic filter which traps the particulate material and upon which those particles burn in the presence of the $NO_2$ formed within the catalyst module. If desired, the catalyst support can also serve part or all of the function of filtering the gas stream. Other modules can be used for other treatments, for example the injection of urea. Additionally, the modules will also serve to attenuate the noise emitted by the engine which the modules serve.

In addition to allowing the designer greater flexibility in designing the treatment chambers to achieve optimum treatment of the exhaust gasses, the use of a modular construction enables the operator to remove one or more of the modules for cleaning and servicing or replacement. For example, it has been found that the performance of the filter module can be prolonged if the module is removed and replaced in the silencer assembly with its orientation reversed, thus reversing the direction of flow of the exhaust gases through the filter element.

Such modules are preferably secured together as an axial series of components by releasable joint mechanisms in which outwardly extending radial flanges at opposed ends of adjacent modules are secured together with a compressible gasket forming a gas-tight seal between the opposed faces of the flanges. The accepted method for securing the flanges together, whilst retaining ease of dismantling the joint, is to form the flanges as opposed axially inclined radially outwardly directed shoulders and to apply a V section strap with a circumferentially acting clamp upon the shoulders of two adjacent modules. Upon tightening of the clamps, the straps contract radially upon the taper of the shoulders and thus lock the modules together and clamp the shoulders axially upon a gasket located between them to form a gas-tight joint between the modules. Silencers incorporating treatment chambers using such a modular construction are commercially available from the Applicants under the Trade Mark Greencat.

For convenience, the term silencer will be used hereinafter to denote in general chambers for the treatment of exhaust gases to remove noxious materials from the gas stream and which also by design or co-incidentally may attenuate the exhaust noise from an internal combustion engine.

However, such a construction using a plurality of modules may result in a silencer assembly which is excessively long. On the other hand, problems are encountered where it is desired to nest modules one within another so as to reduce the axial length of the silencer. It is necessary completely to dismantle such a nested assembly in order to gain access to a module contained within another, so as to be able to remove the circumferential straps securing that module to its neighbour, which is time consuming.

We have devised a form of assembly for a silencer which provides a cheaper and more compact assembly, yet which retains the modular construction and ease of manufacture and flexibility of assembly of the modules.

SUMMARY OF THE INVENTION

Accordingly, the present invention provides an apparatus for treating a gas stream, which apparatus comprises a plurality of compartments within which one or more treatments are to be performed on a gas stream passing through the compartment, and through which the gas stream is to flow sequentially, characterised in that:

a. At least two of said compartments each comprises a tubular body member containing or carrying a treatment element which is restrained against axial movement relative to the body member; and The tubular body members of the adjacent compartments are provided with radially outwardly and/or inwardly extending terminal flanges, at least some of which flanges provide a shoulder against which the opposing terminal portion of the adjacent compartment bears so as to form an axially extending structure comprising at least two compartments in axial or coaxial relationship to one another; and One or more clamping members which extend axially over substantially the length of the said structure and act upon the axial structure to secure the two adjacent compartments together in gas-tight engagement by an axial clamping action.

By forming the silencer or other structure as a series of compartments, the benefits of the modular design of the structure, including the ability to include a range of interchangeable different treatment elements in common sized tubular body members, and the ease of servicing and replacement of individual modules, is retained. By applying axial as opposed to circumferential clamping, a series of modules may be nested upon one another and secured in position by a single external axial clamping system so that dismantling of the structure is simplified. Furthermore, the radially extending flange at the terminal portion of the tubular member serves at least two functions. Firstly, it can be used to form a flange which secures the treatment element within or upon the tubular member against axial movement with respect to that tubular member without the need for providing the separate annular internal flanges or ribs hitherto considered necessary to achieve this function.

Secondly, we have found that where the terminal portion is deformed radially to form the radial flange, the flange is unexpectedly effective in forming a gas-tight seal with an adjacent component of the silencer assembly, for example an adjacent tubular member or end cap of the assembly. We believe that this is because the deformation of the terminal portion of the tubular member does not give rise to a flat radial surface as would have been expected and which a designer in this field would have said was desirable. We have found that the deformation causes the formation of a slight bow on the axially exposed radial surface of the deformed portion of the tubular member. This bow provides an area of localised pressure when the tubular member is clamped axially against another component of the silencer assembly. Furthermore, the deformation can be carried out to fold the terminal portions of the tubular bodies through angles from less than 90° to more than 90°. Where the deformation is through less than 90°, the opposed radial flanges can be deformed further during the axial clamping of the assembly to provide a measure of resilience within the axial structure to accommodate differential expansion of the axial clamping means and the assembly during use. Where the deformation is through more than 90°, the deformation provides internal or external flanges which can bear against the terminal portion of a treatment element carried in or upon the tubular body and thus locate the treatment element axially upon the tubular body.

The axial clamping can be applied to structures which have a wide range of transverse shapes. This is to be contrasted to the use of circumferential clamps which are limited to use on substantially circular cross section structures.

The invention thus provides a simple and effective design for an axially compact multi-compartment gas treatment vessel with unexpectedly effective sealing between adjacent components and with a wide range of transverse shapes.

As indicated above, the invention can be applied to the treatment of a wide range of gas streams from a variety of sources, for example in the treatment exhaust gases from a coal burning furnace or the emissions from a chemical process. However, the invention is of especial application in the treatment of the exhaust gases from internal combustion engines, notably diesel or spark ignition engines. With such exhaust gas streams, a series of treatments can be carried out using the nature of the contaminants in the exhaust gases to form reagents in the gas stream which can be used to eliminate or reduce other contaminants in a subsequent treatment. The engine may be a stationary engine, for example driving an electricity generator or an hydraulic fluid compression unit, or a marine engine. However, the invention is of especial application in the treatment of the exhaust gases from a diesel engine in a modular silencer assembly on a motor vehicle to attenuate the engine noise and to reduce the noxious emissions from the engine as described above. For convenience, the invention will be described in terms of such a preferred use.

In the silencer assembly of the invention, individual treatment compartments are provided with the radially extending flanges at or adjacent the end of each tubular body member. These flanges can be provided by the use of separate interface components trapped between the terminal circumferential rims of adjacent tubular body members. Thus, the interface member can take the form of an annular member having an annular groove in each face thereof into which the terminal rims of the tubular members engage axially. If desired, the interface member can extend axially either within, and/or upon the outer face of, the tubular members to serve to locate and restrain the terminal portions of the tubular member. Thus, the interface member can be in the form of an axially extending collar or sleeve having a radially inwardly directed rib or flange so that the interface member has a generally T shaped cross section, with the upright of the T located between the rims of the adjacent tubular body members. If desired a gasket material can be provided on the interface member or located between the interface member and the ends of the tubular members.

However, it is preferred to provide the radial flanges on the tubular body members by deforming the terminal portions of a generally tubular housing containing or carrying the appropriate treatment element. Such housings may be cylindrical, annular in shape or have other cross-sectional shapes, for example oval or polygonal. For convenience, the invention will be described hereinafter in terms of generally cylindrical tubular body members.

Preferably, the terminal flanges are formed at or adjacent each end of the tubular body member so that each compartment of the silencer can be secured to adjacent compartment (s) using a jointing system of the invention. By forming the radial flanges by in-folding the wall of the tubular member, the flanges are recessed within the radial dimensions of the body members, so that the joints securing the compartments together do not project significantly radially, thus overcoming one of the problems with the present form of silencer jointing systems. Furthermore, the absence of radial projections enables modules to be nested within one another without the formation of annular gaps between them, assisting the formation of a gas-tight structure.

However, it is within the scope of the present invention for the flanges to be formed as radially outwardly extending flanges. These flanges also serve as the seat upon which an adjacent tubular body can locate. Alternatively, or in addition, the radially outwardly extending flanges can provide a radial shoulder which restrains an annular treatment element carried externally journalled upon the tubular body against axial movement on the body member. For convenience, the invention will be described hereinafter in terms of a tubular member carrying the treatment element located within the bore of the tubular member.

Typically such tubular body members contain a cylindrical core of the treatment element appropriate to the treatment which is to be carried out in that module of the silencer assembly. Thus, one body member will usually contain a cylindrical core of a through-flow porous or apertured ceramic support (which may also act as a filter) carrying the catalyst dip coated or vapour deposited within the gas flow passages thereof; and another will contain a filter core having a plurality of axial bores closed at alternate ends so as to provide a tortuous path for gas through the filter element. Such cores, their design and manufacture can be of conventional nature. The cores are typically surrounded by a shock absorbing material, for example that material comprising vermiculite granules in a fibre reinforced binder, notably that sold under the Trade Mark Interam.

The tubular body member is typically made by compressing an axially split cylinder of metal, for example stainless steel, strip around a sleeve of the shock absorbent material encasing the treatment element so as to form the cylindrical body member around the internal components, and securing the butting axial edges together. Such techniques can be carried out using any suitable technology and produce a tubular body member containing the treatment element secured radially within the tubular body member.

For convenience, the invention will be described hereinafter in terms of a module comprising a generally cylindrical steel tubular body member formed about a cylindrical treatment element and an interface layer or layers of a shock absorbing material between the tubular housing and the treatment element.

The treatment element is secured against axial movement within the tubular body member by any suitable means. In some cases the radial compression of the shock absorbing interface between the interior of the tubular member and the external face of the treatment element will provide sufficient frictional forces to retain the treatment element in position during normal use conditions. Alternatively, one or more internal radial projections may be provided to form stops against which the axially exposed terminal faces of the treatment element bear. For example, an internally projecting circumferential radial ridge can be formed by roll indenting the wall of the tubular member; or one or more internal circumferentially complete or interrupted flanges can be welded or otherwise secured within the bore of the tubular body member.

However, it will usually be preferred that the terminal deformation of the tubular body member provides a radially inwardly directed annular flange against which the axially exposed transverse face of the treatment element or a portion thereof. If desired the terminal portion of the tubular body member may be provided with a plurality of circumferentially spaced apart axial cuts so that parts of the terminal portion can be in-folded to provide the flanges against which an internal treatment element bears and other parts can be out-folded to provide radially outwardly directed partial flanges. For convenience, the invention will be described hereinafter in terms of a tubular body member in which the whole circumference of the terminal portion is deformed inwardly to provide an inwardly directed flange.

The radially inwardly directed flange of the invention at either or both ends of the tubular housing member can bear directly against the exposed end face of the treatment element. If desired, an annular metal mesh gasket or other deformable thermally stable material may be incorporated as a compressible interface between the axially exposed terminal face of the treatment element and the in-folded flange of the invention.

The in-folded flange of the invention preferably extends radially inward to provide a satisfactory restraint for the treatment element without restricting the flow of gas through the tubular member excessively. Typically, we have found that an in-folded flange having a radial dimension of from 1 to 2.5 cms will be satisfactory for most applications. However, the optimum radial extent of the flange can readily be determined by simple trial and error tests.

The in-folded flange is conveniently formed by applying a radially inwardly directed force or pressure to the terminal portion of the tubular housing member so as to fold the wall of the housing inwardly. Preferably, the pressure is applied at a plurality of points around the circumference of the tubular housing by a plurality of forming pieces urged radially inwardly by one or more hydraulic rams or the like. It is especially preferred to stand the tubular housing carrying the treatment element(s) therein upon a base plate so that the exposed rim of the tubular housing adopts a known axial relationship to a series of radially acting pusher members carried by the base member. It may also be desired to rotate the tubular housing about its longitudinal axis during actuation of the pusher members so that a rolling radial deformation of the end of the tubular member takes place. Alternatively, the terminal portion of the tubular member can be forced against a tapered seat to fold the end portion inwardly against the static seat. Other methods, for example hydraulic forming or the use of deformable interfaces, such as rubbers, to apply radial pressure to the tubular member when the interface is subjected to axial pressure, may be used to deform the terminal end portions of the tubular body member.

Surprisingly, we have found that such techniques for forming the in-folded flange at the end of the tubular housing enable the flange to be formed with a high degree of axial accuracy in positioning the in-folded flange against the treatment element within the tubular housing. If desired, the wall of the tubular housing member can be circumferentially scored or cut to assist formation of a sharp bend in the wall of the member. However, we have found that this is not usually necessary.

If desired, notably where deformation methods such as rolling or spinning of the tubular body member are used, the deformed tubular member can be formed to approximately the desired dimensions and flange shape in an initial stage and the deformation completed in a second stage in which the partially deformed tubular member is compressed axially to achieve the desired axial length and radial flange shape. Such final axial dimensions may be achieved by completion of the folding of the wall of the tubular body member to form the radial flange and/or by partial axial compression of the wall of the tubular member where folding of the tubular member cannot accommodate the reduction in axial dimension required.

The extent of the angle of the deformation of the terminal portion of the tubular member, relative to the longitudinal axis of the tubular member, will typically be about 90° so that the resultant radial flange forms a radial shoulder against which the treatment element engages and/or against which the terminal portion of an adjacent tubular body member engages axially. However, if desired, the deformation may pass through more than 90°, for example up to 100°, so that the flange engages and compresses an annular mesh or other compressible gasket against the exposed terminal portion of the treatment element. The flange thus clamps the treatment element axially within the bore of the tubular body member or externally upon it in the case of an annular treatment element, the gasket accommodating manufacturing tolerances in the manufacture of the treatment elements. The method thus produces modules whose axial length is accurately controlled when the flange is formed at each end thereof, thus aiding assembly and clamping of the overall silencer assembly.

As indicated above, the deformation of the tubular member does not form a wholly flat flange. The flange is slightly bowed axially away from the remainder of the tubular member and this provides an annular point loading during clamping of two opposed flanges together, assisting the formation of a gas-tight joint between the faces of the flanges when one tubular member is assembled upon another tubular member or upon another component such as the end cap of the silencer assembly.

If desired, the flange can be formed with a more complex shape than as a simple radial flange. For example, the flange can be formed as a radial step reduction in the diameter of the terminal portion of the tubular body member to provide not only a radial shoulder but an axially extending spigot of smaller diameter which can be used to assist both axial and lateral location and securement of adjacent tubular bodies upon one another.

In use, the silencer assembly is constructed by placing the desired modules in end to end relationship to form the desired silencer configuration, optionally with a suitable gasket between the opposed flanges of the modules. The modules need not all be of the same axial length and more than one module achieving the same treatment of the gas stream passing through it may be used. It will be usual to provide an end cap at each end of the assembly to provide inlet and outlets to the assembly, or to reverse the flow of gas in an assembly comprising cylindrical modules nested within annular modules.

To assist location of one module on another and to provide a measure of lateral support, it is preferred to provide a circumferential collar or other linking piece around the joint between two modules. This jointing piece may extend circumferentially around the joint between two body members and extend axially onto the terminal portion of each body member. Alternatively, the jointing pieces may be axially extending. strips or projections located at, say spacings of from 45 to 120°, around the circumference of the end of the body member and provide a crenellated or similar end to the tubular body member, into which end the terminal portion of the adjacent body member nests. If desired, both body members can carry such crenellated ends which interengage to restrict rotation of the tubular bodies relative to one another and/or to achieve a specific orientation of one member upon the other. For convenience, the invention will be described in terms of an annular collar as the jointing piece.

The collar may be an axial extension of part of the wall of the tubular member or may be a separate component which is a push, screw or other fit upon the opposed portions of the components being joined. Preferably, such a collar is a tight push fit upon the modules and components which are being joined and may be secured in position by welding or other means. For example, the collar can be secured in position by forming a circumferential groove in that portion of the collar which overlies the terminal portion of the body member. This groove will engage in or form a corresponding groove in the underlying tubular body member wall and thus secure the collar and body member against axial movement. The groove will also form an inwardly directed rib on the inner surface of the wall of the tubular member which may act as the flange to locate the treatment element within the tubular body member. The formation of the groove in the collar and underlying tubular body member will also cause a measure of axial contraction of the silencer assembly. If desired, the terminal portion of the tubular body member can be radially recessed to accommodate the collar within the radial dimensions of the tubular body member.

If desired, the collar can be formed with a radially inwardly directed flange formed from or carrying a gasket material which is trapped between the opposed faces of the terminal radial flanges carried by the opposed ends of the adjacent body members.

The assembled modules are secured together by applying an axial clamping force thereto. This clamping force can be achieved in a number of manners using clamping mechanisms which extend axially for substantially the whole length of the assembled modules so that substantially the same compressive force acts upon each joint between adjacent modules. Such a clamping mechanism is distinguished from the conventional discrete jointing mechanisms between the individual modules in that the discrete jointing mechanisms do not extend axially beyond the joint which is being made. Furthermore, since each joint using such discrete jointing mechanisms is made individually, the compressive forces between adjacent modules can often vary considerably, thus leading to differences in the performance of each joint when under stress.

The axial clamping force can be achieved by way of one or more screw mechanisms passing longitudinally from end to end through the silencer assembly and acting axially on exposed end caps of the assembly. However, this imposes limitations on the design of the modules, since each module must then provide for one or more axial passageways therethrough for the screws and such passageways will usually have to incorporate sealing means to prevent gas leakage from one module to another via the screw passageways. It is therefore preferred to provide the axial clamping means by external means acting substantially symmetrically upon the silencer assembly. It will be appreciated that some of the body members may be secured together by welding, but this reduces the modular nature of the construction of the silencer assembly and it will usually be desired that each tubular body member in the assembly be a butting sealing engagement with the adjacent body members so that the silencer assembly can be readily dismantled into its component parts for repair and maintenance. As indicated above, the formation of a circumferential groove in the collar pieces at the junction between adjacent body members causes some axial contraction of the body members and this may be sufficient to achieve the desired gas-tight seal between the components of the silencer assembly.

A particularly preferred form of such an external clamping mechanism is a series of circumferentially spaced apart axially extending tensioning devices, such as metal straps, for example at from 60 to 120° intervals around the body of the silencer. These are secured by a terminal hook or other means to a peripheral lip or ridge at each end of the assembled silencer. Such lip or ridge can be formed as an integral part of the end caps of the silencer. Alternatively, the lip or ridge can be provided by a separate component which bears axially against the end cap when the axial clamping force is applied. For example, the lips can be provided by the ends of one or more spider arms which extend radially across the end face of the silencer assembly and whose free ends provide anchorage points for the axial tensioning devices.

The axial tensioning devices can be tensioned to secure the assembly in its axial configuration by any suitable means. For example, tension may be applied by means of screws, nuts or bolts which secure the ends of straps to the spider arm devices; by twisting adjacent straps together; by applying a transverse force to the straps, for example by pulling them sideways to attach to hooks on the exposed wall of the silencer assembly in a manner similar to that used to tension a drum skin; by wedges or other means. Alternatively, the straps can be tensioned by an over-centre tensioning device, by the use of tension springs in the mounting and/or securing of the straps, or by applying the straps hot and allowing them to cool and contract once in situ.

The straps may take the form of simple flat straps, bars or braided wires or cables. However, it is particularly preferred to incorporate a measure of extensibility into the straps or the means by which they are secured so that the axial clamping mechanism can accommodate differential expansion between silencer assembly and the axial clamping mechanism so that the clamping assembly components are not stretched beyond their yield point during use of the silencer assembly. Such extensibility can be achieved by forming the metal straps with a zigzag profile, which can be formed during tensioning of the straps to reduce the axial length of the straps; or by providing a spring loaded release mechanism in any over-centre tensioning device. Alternatively, the straps may be formed in two or more portions which are tensioned and then secured to one another by frangible connectors which fail or stretch once a load in excess of a given value is applied to the straps. Where a single or multiple spider arm assembly is used to locate and secure the ends of the straps, the arms may extend beyond the periphery of the end cap upon which the spider is located to provide a measure of cantilevering to the ends of the arms which will absorb the forces resulting from any differential expansion. Alternatively or in addition, the hooks or other means by which the tensioning straps are secured can incorporate a spring mechanism or spring portion.

A particularly preferred form of tensioning mechanism, which also provides a measure of extensibility in the securement of the straps, comprises a plurality of straps carrying a hook or other securing means at each end thereof which are to engage with a tensioning ring located upon the end cap of the silencer assembly, for example by a continuous or discontinuous raised annular peripheral rim to the end cap or an axial extension of the cylindrical wall of the terminal tubular body member of the silencer assembly. The tensioning ring is formed with a wavy, sinusoidal, crenellated, zigzag or other undulating shape which provides localised axially elevated portions of the ring with which the hooks of the straps are to engage, axially lower portions which bear against the end cap of the silencer assembly, and intermediate linking portions. Preferably, the linking portions are inclined, for example at from 30 to 60°, to the plane of the ring so as to provide a spring and/or torsion bias effect to the connection of the elevated portions to the lower portions. The linking portions may be directed radially outward so that the elevated portions are radially off set from the radially inward lower portions and may extend radially outward of the circumference of the end of the silencer assembly. When a strap is connected to an elevated portion and tensioned, the linking portions provide an opposing torsion and/or spring force which opposes axial movement of the elevated portion of the ring. By suitable selection of the material of construction of the ring, the torsion or spring forces in the linking portions of the ring can be maintained over the expected operating conditions of the silencer so that the elevated portions of the ring do not collapse axially. Such a ring thus accommodates differential expansion between the strap and the silencer body.

Tensioning of the straps can be achieved by levering the hooked end of the strap over the elevated portion of the ring using a lever or the like. The first strap can be readily tensioned by applying the hooked end of the strap to an elevated portion of the ring whilst the ring is pivoted about the lower portions adjacent to that elevated portion to adopt a position normal to the plane of the cap of the silencer assembly. In this position, the elevated portion is moved axially towards the other end of the silencer assembly and the strap can be readily hooked onto the elevated portion of the ring. However, when the ring is pivoted to lie against the end of the silencer assembly, the elevated portion moves axially away from the other end of the silencer assembly and inherently tensions the strap.

If desired, a portion of the vehicle or other structure upon which the silencer assembly is to be mounted can provide part of the clamping mechanism. For example, one end of the silencer assembly can seat upon a portion of the vehicle chassis and the axial clamping means can be connected to the chassis rather than to a spider or other means at that end of the silencer assembly.

The invention has been described above in terms of a simple axial assembly of the silencer modules. However, the invention can be applied to nested modules in which one or more cylindrical modules are placed within annular modules. In this form of silencer assembly, the lack of radial projections from the tubular body members at the joints between them and other tubular body members is a major benefit, since this reduces the formation of annular gas passages within the silencer assembly. However, as stated above, the radial flanges formed by deforming the ends of the tubular body members may by directed radially outwardly so that they serve as shoulders against which the terminal portion of an annular treatment element journalled upon a tubular member can bear as well as providing a flange to form a gas-tight seal between adjacent tubular body members. The ability to form such assemblies enables the designer to achieve a silencer assembly in which gas flows in one direction within the cylindrical modules, is collected by a suitable end cap and directed in the opposite direction through the outer annular modules, or vice versa. Such an assembly enables an axially compact silencer assembly to be achieved. Alternatively, urea or some other material may be injected into the partially treated gas stream in the end cap connecting the cylindrical modules with the annular modules so that different conditions may be achieved in different portions of the silencer assembly.

The invention has been described above in terms, of a silencer for use with a diesel engine. However, the invention can also be applied wherever it is desired to form a modular unit for the treatment of a gas stream, for example in the treatment of exhaust gases from a coal burning furnace or the emissions from a LPG powered engine.

BRIEF DESCRIPTION DESCRIPTION OF THE DRAWINGS

A preferred form of the joint of the invention will now be described by way of illustration with respect to a silencer as shown in the accompanying drawings, in which FIG. 1 is an axial section through the silencer;

DESCRIPTION OF THE PREFERRED EMBODIMENT

Figure 1:
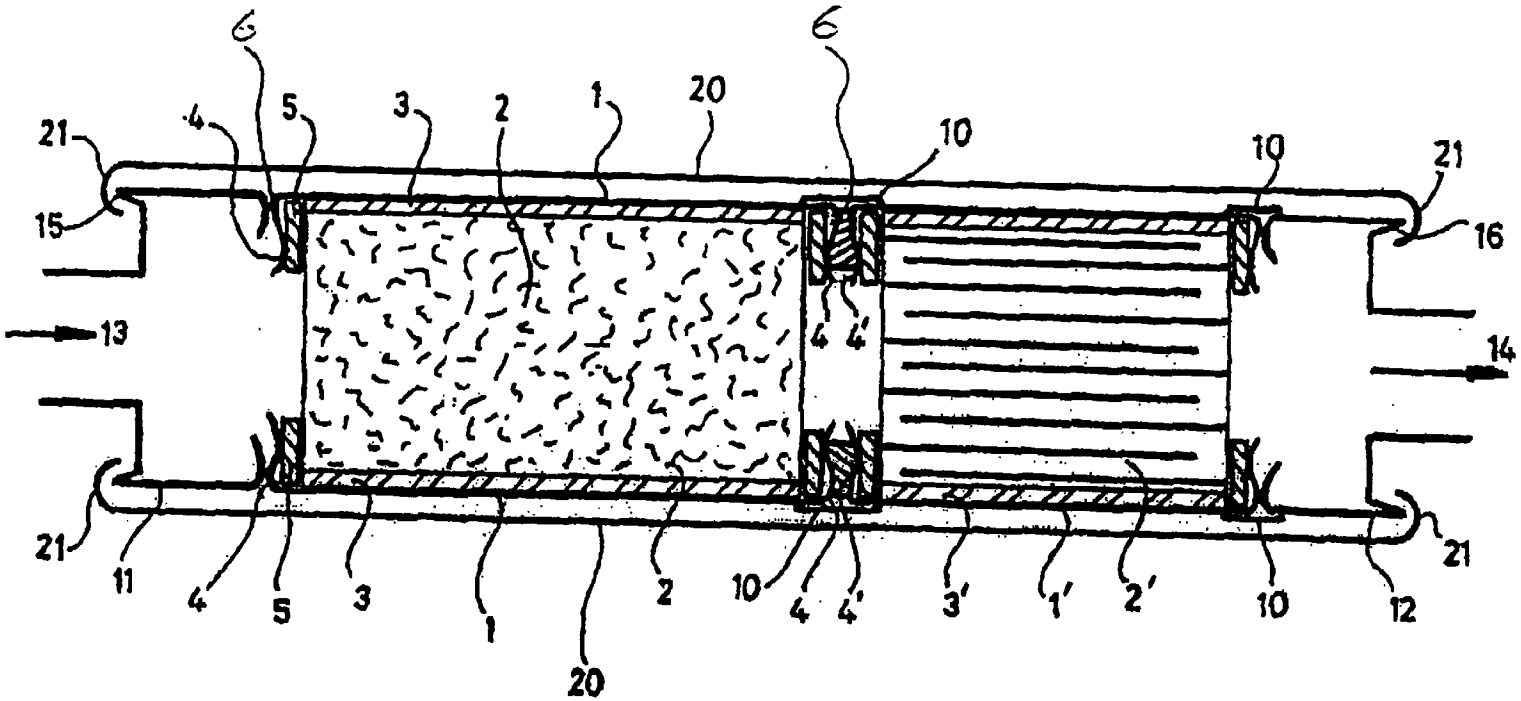

The silencer comprises two or more modules each comprising a tubular body member 1, containing a cylindrical treatment element 2 surrounded by a sleeve 3 of the shock absorbent material sold under the Trade Mark Interam. For example, one tubular body member contains a foraminous ceramic frit core carrying a Rhodium/Platinum catalyst deposited on the exposed surfaces within the core; another tubular body member contains a cast ceramic filter element having a plurality of axial passages therein alternatively open to each end of the element and being formed from a porous ceramic so that the flow path for gas through the filter element is tortuous.

Each end of the tubular member 1 is formed with an in-folded flange 4, which provides an annular internal shoulder 6 within the bore of member 1 against which the terminal portion of the treatment element 2 engages. The flange may be circumferentially continuous or intermittent. It will usually be desired to provide an annular ring 5 of metal mesh or similar compressible material between the ends of the treatment element 5 and the shoulder 6 of flange 4 to accommodate the axial compressive forces as the flange 4 is in-folded against the treatment element. It will also usually be desired that the flange 4 be in-folded through more than 90°, e.g. through 92 to 105°, so that it compresses ring 5 against the exposed end face of the treatment element 2.

The axial length of housing member 1 is selected so that that the flange 4 is formed at the correct axial position to achieve the required axial length of the module. We have found that the in-folding of the terminal portion of housing member 1 can be achieved with axial accuracy so that modules having accurately controlled axial dimensions can be fabricated and the compression of the ring 5 accommodates tolerances during manufacture of the treatment elements 2.

The formation of the annular shoulder 6 provided by the in-folded flange 4 avoids the need to provide separate internal annular flanges within tubular member to retain the treatment elements as hitherto considered necessary.

The modules of the silencer assembly are secured together by applying a collar 10 around the butt join between adjacent modules. If desired, an annular gasket may be located between opposed flanges 4 or the opposed faces of the flanges 4 may carry a resilient coating or layer which provides the gasket. However, in some cases we have found that the slight bow formed in flange 4 provides an adequate seal between the opposed flanges of adjacent modules in the absence of a gasket.

An end cap 11, 12 with the appropriate inlet 13 and outlet 14 is placed terminally upon such an assembly. The end caps will usually incorporate an upstanding peripheral axial rim or ridge 15, 16.

The silencer assembly is then secured by applying axial straps 20 thereto. The straps 20 carry a hook 21 at each end thereof which is levered onto the rims 15, 16 of the ends caps 11, 12.

Figure 2:
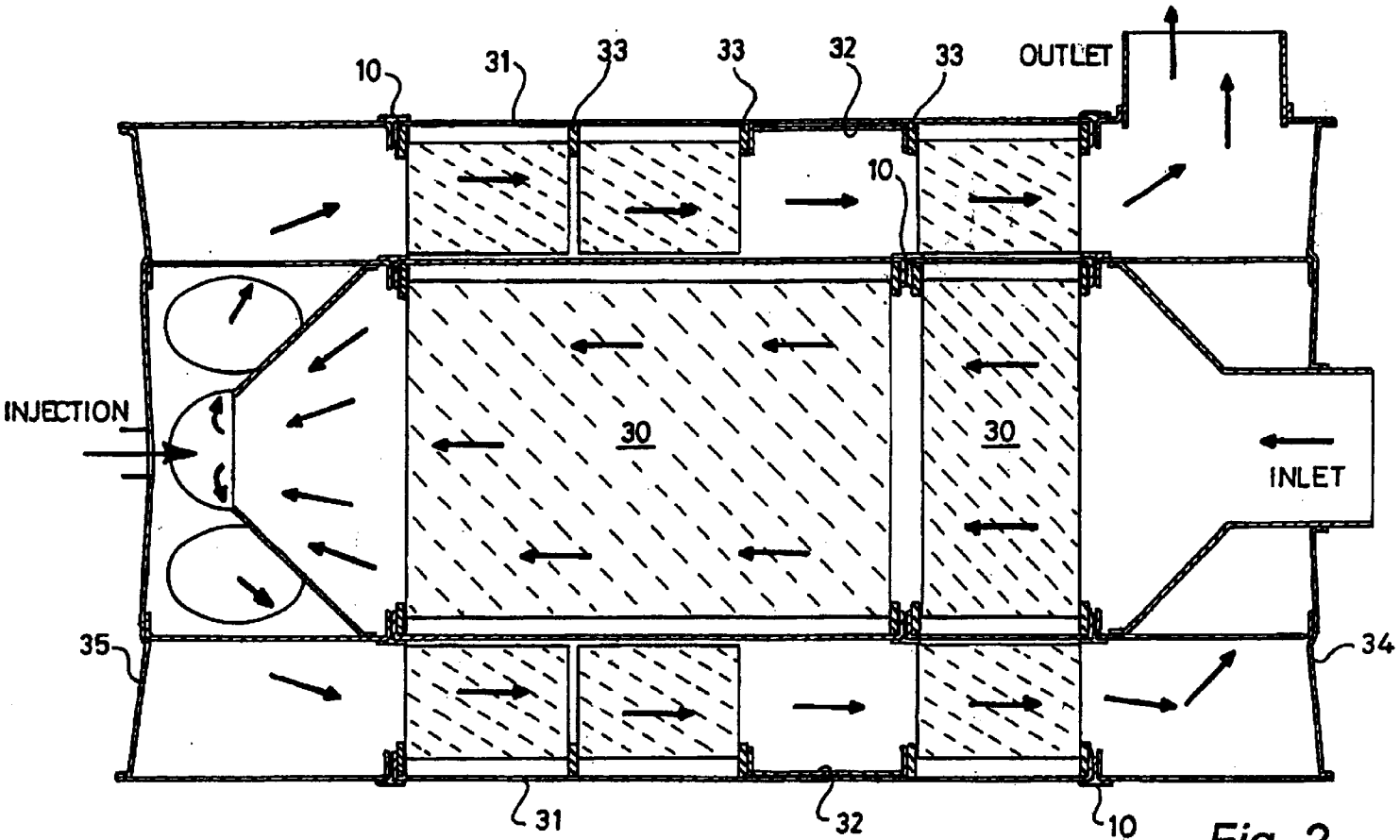
FIG. 2 shows an alternative form of the silencer assembly of FIG. 1.

As shown in FIG. 2, the silencer assembly preferably comprises a series of cylindrical modules 30 located within an outer series of annular modules 31. If desired, spacers 32 may take the place of some of the treatment elements so that the inner and outer strings of modules extend for same axial distance.

If desired, a module can contain a number of treatment elements having compressible gaskets 33 therebetween to accommodate variations in the axial lengths thereof. External axial clamping applied to the end caps 34, 35 of such an assembly, applies an axial clamping force to both the outer annular modules and to the inner cylindrical modules so as to achieve a gas-tight assembly without the need for separate clamping of the inner modules.

Such an assembly not only achieves axial foreshortening of the silencer assembly, but also enables a treating material, for example urea, to be injected into the end cap where the gas flow direction is reversed, so that different conditions and treatments can be achieved in the annular modules than that achieved in the cylindrical modules. The relative position of the inlet 36 and the outlet 37 can readily be altered by rotating the components of the end cap 34.

Figure 3:
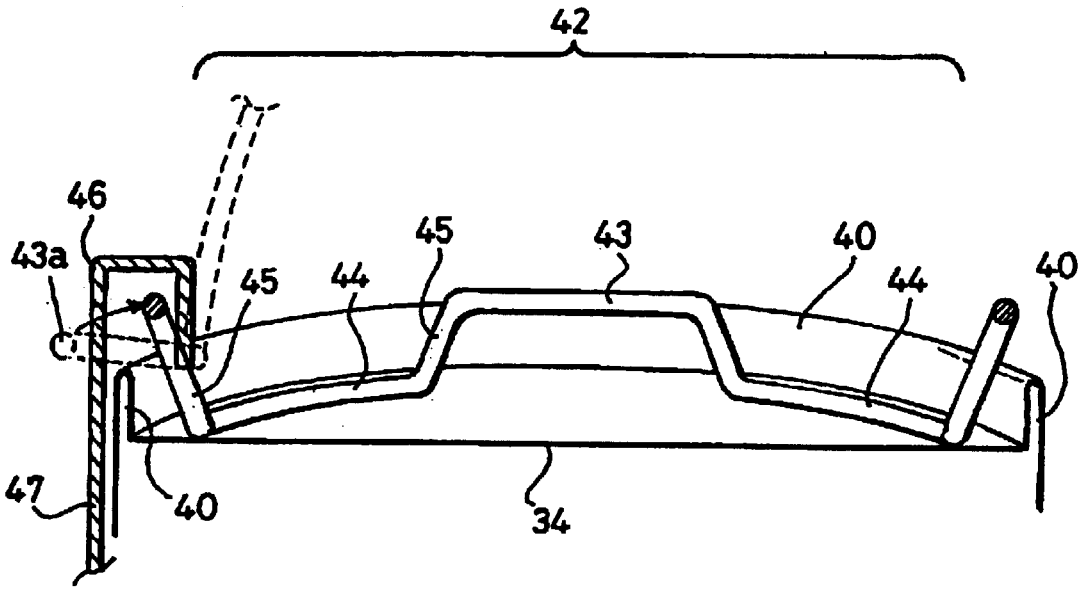
FIG. 3 is a diagrammatic representation of a strap securing and tensioning ring for use with the assemblies of FIG. 1 or 2.

FIG. 3 illustrates a preferred form of anchoring the straps to the silencer assembly. Either or both end caps 34 and 35 of the assembly shown in FIG. 2 are provided with a peripheral axially upstanding rim 40. Located within rim 40 is a metal or other material ring 42 having elevated and lower portions 43 and 44 linked by inclined intermediate portions 45 so that the ring has a generally wavy or sinusoidal configuration. The terminal hooks 46 of axial straps 47 are levered onto the elevated portions 43 of the ring 42 and clamp the silencer assembly axially. The first strap is secured to the ring 42 by pivoting the ring 42 to adopt an orientation normal to the plane of the end cap as shown dotted. This moves an elevated portion 43*a* axially towards the other end of the assembly so that the hook may be readily engaged with that elevated portion. The ring 42 is then pivoted to lie against the end cap as shown in FIG. 3, thus tensioning the strap.

Figure 4:
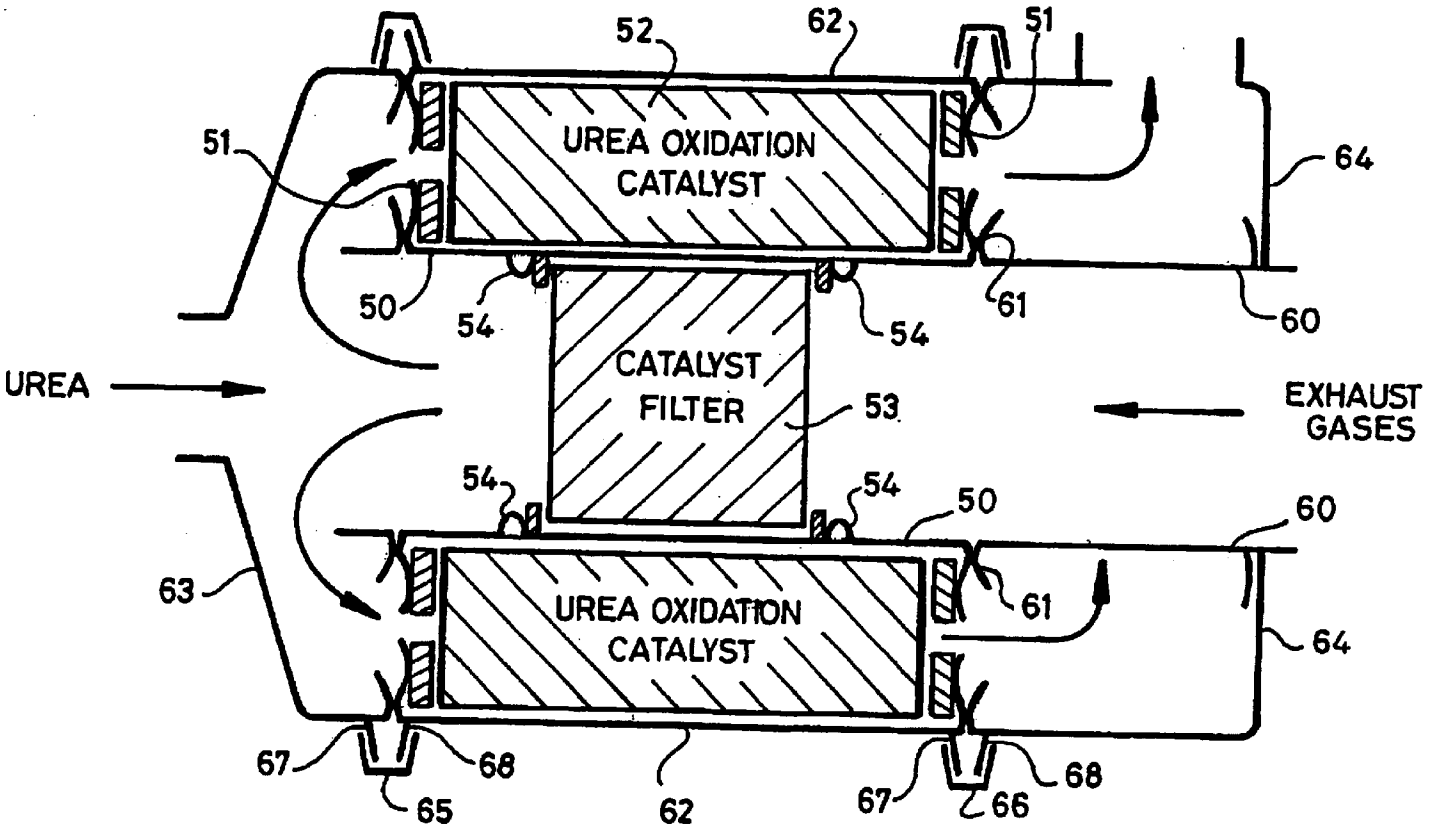
FIG. 4 shows a tubular body member having radially outwardly directed flanges.

As shown in FIG. 4, the end portion of the inner tubular body member 50 can be deformed outwardly to form an outwardly directed flange 51. An annular treatment element 52 journalled upon the tubular body member 50 can be secured axially against the flange 51 as described above for the treatment element located within the tubular body member 50. Usually, the frictional forces between the body member 50 and a cylindrical treatment element 53 located within the body member will retain the axial location of the treatment element 53. However, if desired, two inwardly directed circumferential ribs 54 in the wall of tubular member 50 can be formed by a suitable rolling technique at the appropriate locations to provide internal stops in the body 50 to retain the element 53 in the desired axial location within the body 50. The axially exposed faces of the flanges 51 may also serve as abutting flanges with a suitable gasket material therebetween when two tubular body members 50 and 60 carrying outwardly directed flanges 51 and 61 are located axially upon one another. In the assembly shown in FIG. 4, the member 60 is the inlet tube for the silencer.

Such a structure provides both internal and external treatment elements 52 and 53 carried upon a common tubular element 50. Two or more such structures can be inserted into an outer container 62 and ends caps 63 and 64 secured thereto by means of circumferential V straps 65 and 66 engaging upon angled d 68 carried by the container 62 and the ends Upon tightening the straps 65 and 66, they us applying an axial force upon the end caps This axial force causes the internal components to be clamped axially to form a gas-tight structure. In this case the container 62 forms the component of the axial which extends axially for substantially the internal components of the silencer assembly.

The invention claimed is:

1. Apparatus for treating a gas stream, which apparatus comprises a plurality of compartments within which one or more treatments are to be performed on a gas stream passing through the compartment, and through which the gas stream is to flow sequentially, characterised in that:

a. at least two of said compartments each comprises a tubular body member containing or carrying a treatment element which is restrained against axial movement relative to the body member; and b. the tubular body members of the adjacent compartments are provided with radially outwardly and/or inwardly extending terminal flanges, at least some of which flanges provide a shoulder against which the opposing terminal portion of the adjacent compartment bears so as to form an axially extending structure comprising at least two compartments in axial or coaxial relationship to one another; and c. clamping means which extend axially over substantially the length of the said structure apply an axial force to the axial structure to secure the two adjacent compartments together in gas-tight engagement by an axial clamping action.

2. Apparatus as claimed in claim 1, characterised in that the clamping means comprise an external container and end caps secured to said external container.

3. (Previously Presented) Apparatus as claimed in claim 2, in which the end caps are secured to the external container by means of circumferential V straps engaging upon angled radial flanges carried by the container and the end caps.

4. Apparatus as claimed in claim 1, characterised in that the transverse cross-section of the tubular members is polygonal.

5. Apparatus as claimed in claim 1, characterised in that at least some of the treatment chambers are nested within others in a generally concentric arrangement.

6. Apparatus as claimed in claim 1, characterised in that the terminal flanges of two adjacent tubular members present axially outwardly bowed surfaces to one another to provide localised sealing pressure when the tubular members are clamped axially.

7. Apparatus as claimed in claim 1, characterised in that at least one of the tubular members contains a treatment element for subjecting the exhaust gases from an internal combustion engine to filtration to remove at least some of the particulate material from the gas stream and at least one other tubular member contains a treatment element for subjecting components in the gas stream to catalytic treatment.

8. Apparatus as claimed in claim 1, characterised in that the terminal portions of the tubular members are in-folded through an angle of 90° or more.

9. Apparatus as claimed in claim 1, characterised in that the axial clamping means comprises axial metal straps located at circumferential intervals around the tubular members.

10. Apparatus as claimed in claim 1, characterized in that the axial clamping means is provided with spring means for retaining tension within the axial clamping means during use of the apparatus.

11. An internal combustion engine provided with a silencer comprising an apparatus as claimed claim 1.

* * * * *